United States Patent [19]

Page

[11] 4,285,767

[45] Aug. 25, 1981

[54] HEADBOX HAVING ADJUSTABLE FLOW PASSAGES

[75] Inventor: Robert E. Page, Davis, Ill.

[73] Assignee: Beloit Corporation, Beloit, Wis.

[21] Appl. No.: 886,278

[22] Filed: Mar. 13, 1978

[51] Int. Cl.[3] ..... D21F 1/02; D21F 1/06

[52] U.S. Cl. ..... 162/216; 162/343

[58] Field of Search ..... 162/101, 216, 336, 343, 162/344, 347

[56] References Cited

U.S. PATENT DOCUMENTS

| | | | |
|---|---|---|---|
| 3,716,449 | 2/1973 | Gatward et al. | 162/101 |
| 3,798,122 | 3/1974 | Appel | 162/101 X |
| 3,802,960 | 4/1974 | Spengos | 162/216 |
| 3,837,999 | 9/1974 | Chung | 162/101 |
| 3,937,273 | 2/1976 | Radvan et al. | 162/216 X |
| 4,021,296 | 5/1977 | Reiner | 162/216 X |
| 4,125,429 | 11/1978 | Hergert et al. | 162/317 |

*Primary Examiner*—S. Leon Bashore
*Assistant Examiner*—Steve Alvo
*Attorney, Agent, or Firm*—Hill, Van Santen, Steadman, Chiara & Simpson

[57] ABSTRACT

A headbox for supplying a stock consisting of a generated liquid foam suspension of fibers or a high consistency paper making stock including a slice nozzle having a slice opening and a slice chamber having first and second slice flow passages arranged of a set of stepped surfaces leading to the slice nozzle with one set of the surfaces of the slice chamber mounted on a movable block to increase or decrease the size of the passages of the slice chamber, said stepped surfaces shaped to generate a turbulent expansion and shearing action on the foam for a regenerative process, and a tube bank and header chamber delivering foam to the slice chamber passages.

4 Claims, 4 Drawing Figures

HEADBOX HAVING ADJUSTABLE FLOW PASSAGES

BACKGROUND OF THE INVENTION

The present invention relates to improvements in structures for forming a fibrous web from a suspension of fibers in a stock, and particularly to a headbox for handling a stock formed of a generated foam or a high consistency paper making stock.

In the manufacture of fibrous webs, particularly from synthetic fibers, one method which has been developed involves suspending the fibers in a foam suspension. The system for one such arrangement is disclosed in U.S. Pat. No. 3,716,449.

In handling the foam generated by the process taught in the aforesaid patent, a requirement is that the foam not be permitted to break down so that the fibers are uniformly carried and uniformly distributed. To accomplish this, the foam must be uniform and even in the bubble formation and this can be accomplished by continual regeneration of the foam in its flow through the system toward the forming surface.

In supplying the foam with the fibers suspended therein, its flow must be controlled so that the desired amount of fibers are fed to the forming surface at the speed desired. For the formation of a thicker web, a greater quantity of foam is supplied carrying a larger number of fibers onto the forming surface. The supply of fibers delivered to the forming surface also must be increased when the speed of the forming surface is increased. Likewise, for thinner web or a slower operating speed, the amount of foam fed to the forming surface is decreased.

The foam is generally supplied through a headbox arrangement. In the process the foam is first generated with the fibers distributed throughout the foam, and the foam is then flowed through a control headbox onto the forming surface. The control headbox optimumly must maintain uniformity of flow of the foam therethrough for uniform distribution of the foam out of the slice opening from the slice chamber. Also optimumly, a breakdown of the foam must be prevented and for a good procedure, foam regeneration should take place wherever possible throughout the system until the foam is delivered onto the forming surface.

It is accordingly an object of the present invention to provide an improved headbox for handling the flow of foam and delivering a uniform controlled supply of foam onto a forming surface where the flow can easily and readily be controlled.

A further object of the invention is to provide a foam flow headbox which provides for constant regeneration of the foam in the flow therethrough.

A still further object of the invention is to provide an improved foam supply headbox for the formation of a fibrous web in which the flow of foam is maintained uniform throughout the headbox and the quantity of foam flowing through the headbox can easily and quickly be controlled by the provision of a unique structure.

A further object of the invention is to provide a headbox of improved structure capable of handling a high consistency paper making stock.

Other objects, advantages and features, as well as equivalent structures which are intended to be covered herein will become more apparent with the teaching of the principles of the invention in connection with the disclosure of the preferred embodiment in the specification, claims and drawings, in which:

DRAWINGS

DESCRIPTION

Figures 1, 2, 3, 4:
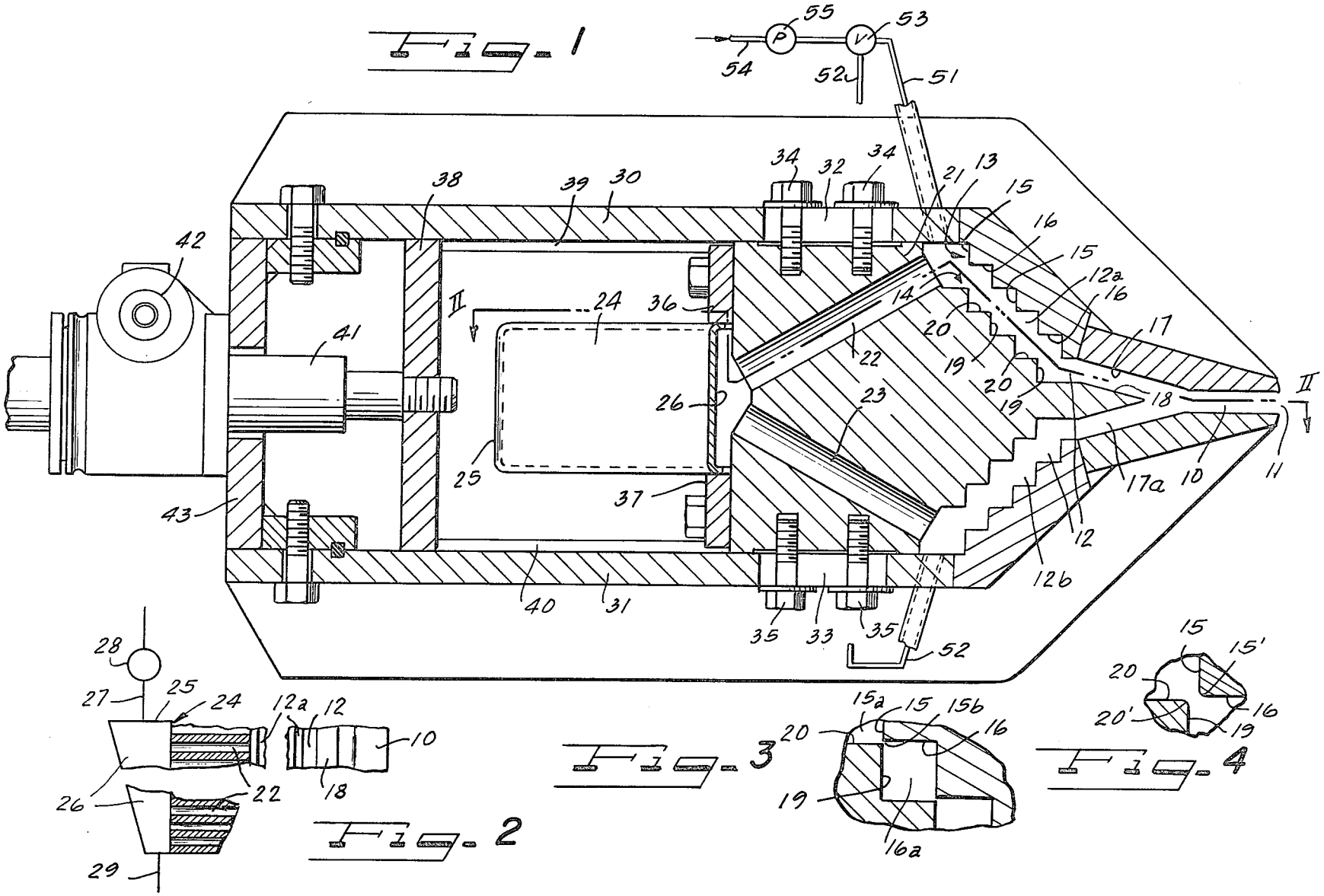
FIG. 1 is a side elevational view of a headbox with a vertical section taken through the headbox constructed and operating in accordance with the principles of the present invention.
FIG. 2 is a horizontal sectional view taken substantially along line II—II with portions of the mechanism omitted for clarity.
FIG. 3 is an enlarged fragmentary sectional view showing a shape of the surfaces within the headbox.
FIG. 4 is an enlarged fragmentary sectional view showing a modified form of the structure of FIG. 3.

As illustrated in FIGS. 1 and 2, the mechanism handles a fibrous foam suspension which flows out through a slice throat or nozzle 10 leading to a slice opening 11 to be deposited on a forming surface, not shown. On the porous forming surface, the stock is dewatered and if a foam stock is used, the foam is broken down to deposit the fibers suspended therein and form a web.

The headbox of the invention is particularly well adapted to use with a stock having fibers supported on a fine foam and is equally capable of handling a high consistency paper making stock. For convenience of description, the structure and operation will primarily be described in connection with the use of a foam stock, but it will be understood that these terms are used by way of description and not by way of limitation.

The foam carrying the fibers is delivered to the slice throat from a slice chamber 12 having a first flow passage 12*a* and a second flow passage 12*b*. These flow passages 12*a* and 12*b* extend diagonal toward the flow axis of the slice nozzle 10 and are defined by generally convergently related surfaces of a rectilinearly movable block or head 21 and complementary surfaces of walls defining the slice chamber 12. While in some arrangements a single flow passage could be employed, the utilization of two flow passages obtains better control and when foam is used, obtains increased surface for continual regeneration as the foam flows through the headbox. It is also contemplated that additional flow passages could be provided for supplementing the flow of the two flow passages shown, but the two flow passages are advantageous because with the unique constructions to be described, they permit change of the cross sectional size of each of the flow passages simultaneously to increase or decrease the volume of foam flow and to maintain the regenerative effect on the foam the same in each of the flow passages inasmuch as they narrow or widen uniformly with movement of the head block 21. When a high consistency paper making stock is used, the flow passages are shaped to create a tubulence which helps maintain the fibers in uniformly distributed and uniformly oriented pattern within the stock.

Inasmuch as both of the flow passages are essentially uniform in construction and size, only the flow passage 12*a* need be described in detail. The flow passage 12*a* contains an outer or stationary undulated area surface 13 and a lower or movable undulated flow area surface 14. The flow surfaces are made up in a preferred form of a plurality of smaller surfaces extending at right angles to each other. The slice chamber passage 12*a* has a plurality of small surfaces 16 which extend in a direction essentially parallel to the flow through the slice throat 10. That is, in the general direction of flow which is commonly termed the machine direction in the term of paper making art. The flow passages also comprise a plurality of inbetween flat surfaces 15 which extend at right angles to the flow passage surfaces 16 and at right angles to the direction of flow of the foam through the throat 10. These flat surfaces 15 and 16 extend continuously across the width of the headbox which is the cross-machine direction.

Similarly, the lower or movable area surface 14 includes a plurality of flat surfaces 20 which extend in the direction of flow through the throat 10. The area surface 14 also includes a plurality of flat surfaces 19 which extend at right angles to the direction of flow of the stock through the throat 10. These surfaces 19 and 20 join each other at right angles and extend continuously across the width of the machine. The first flow surfaces 16 and 20 which extend in the direction of flow are substantially parallel to each other and are substantially in alignment so that as the movable head 21 is brought up close to the stationary head portion, the surfaces tend to come together and the peaks between the surfaces throttle the flow. A projection 18 extends from the head 21 toward the throat in the direction of stock flow.

FIG. 3 illustrates a preferred form of structure wherein the flat surfaces 19 and 20 or the flat surfaces 15 and 16 join at a relatively sharp angle. In another form, as illustrated in FIG. 4, the surfaces 15 and 16, and the surfaces 19 and 20 may join each other at a small radius as illustrated at 15' and at 20' respectively. The arrangement of surfaces may be termed a modulated step configuration.

As shown in FIG. 3, the surfaces have been brought more closely together for purposes of illustration, and the flow will flow from a series of larger chambers **15*a* through their restriction portion shown at 15*b* into the larger chamber 16*a*. This throttling of the flow from a larger chamber through a throat and back to a larger chamber performs a constant regenerative effect as the foam bubbles are compressed and re-expanded and insures the maintenance of a uniform bubble size and a uniform distribution of fibers. As the miniature bubbles flow, they continually change direction and are swirled or tumbled to impact against the flat surfaces 15, 16, 19 and 20**, and to then flow parallel to these surfaces only to again be forced to change direction by another right angle flat surface.

Where a high consistency stock is used instead of a foam, the structural relationship of the flat surfaces and the throttling of the flow performs a beneficial function similar to that on the foam. The continual compression and expansion chambers which are formed causes a fine scale turbulence in the high consistency stock maintaining the random orientation of the fibers and maintaining and improving the quality of the stock which flows out toward the throat and through the slice opening.

As the flow of stock passes down through the first and second flow passages **12*a* and 12*b*, it passes into a final merging flow portion 17 and 17*a* to merge at the throat 10**.

The stock flows into upstream portions of the flow passages **12*a* and 12*b* of the slice chamber from tube banks 22 and 23 which provide supply passages extending through the head block 21, and which are a plurality of diverging tubes leading from a header 24 to discharge into the slice chamber flow passages. The tube banks comprise a plurality of tubes uniformly spaced extending across the movable head 21** of the headbox.

The header 24 leads from a larger end 25 and tapers down to a smaller end 26, FIG. 2. The foam is supplied through a supply conduit 27 to the larger end from a pump 28, and excess foam is recirculated through a line 29 leading from the smaller end.

An advantage of the mechanism is that the header 24 is carried with the movable sliding head 21 as it moves to increase or decrease the size of the legs of the slice chamber. For supporting the header on the movable head, it is mounted on blocks 36 and 37 which are bolted onto the head.

The headbox includes an upper plate 30 and a lower plate 31 which provide upper and lower guides for the movable head 21. The plates are provided with slots 32 and 33, through which extend guide bolts 34 and 35 which thread into the head 21 and slide in the slots. These bolts will guide the head and can be used to lock the head in an adjusted position.

For providing the power to move the head laterally, a Duff Norton screw jack 42 is provided with a reciprocating shaft 41 extending through an opening in a plate 43 and being connected to a plate 38. The plate 38 provides a drive, sliding between the upper and lower plates 30 and 31, and connects to drive rods 39 and 40 which connect to the movable head 21 and extend above and below the header 24. For movement of the head 21 to the right or left, the Duff Norton jack 42 is operated to slide the assembly including the plate 38 and the connecting rods 39 and 40 with the head 21 to the right or to the left, as shown in FIG. 1.

In some structural arrangements, it is advantageous to provide fluid supply lines such as 51 and 52 leading to the slice chamber in advance of the passages **12*a* and 12*b*. These supply lines are used to add a fluid to the liquid flowing through the slice chamber and where the slice chamber is conducting foam, additional air and/or detergent may be added, or additional pregenerated foam, which provides the desired consistency for the regeneration which occurs through the passages 12*a* and 12*b*. Where the headbox is used for water based stock, additional stock or additional fibers may be inserted through the lines 51 and 52. As illustrated for the line 51, a control valve 53 may be provided to balance the flows through lines 51 and 52 which are delivered from a pressure supply line 54 which may have a pump 55** therein.

In operation, the foam stock or high consistency stock is supplied to the header 24 and flows uniformly through the distributor tubes 22 and 23 into the flow passages **12*a* and 12*b* of the slice chamber. The width of these legs is determined by the lateral position of the head 21. As the stock flows through the two legs, it is continually regenerated by being forced through the constricted undulating passages by the compression and re-expansion and with uniform flow. The stock enters the throat 10 and exits through the slice throat opening 11** onto a forming surface.

The aqueous foam is continually treated to a regenerative action in accordance with the method of the invention, while it flows through the headbox. The high consistency stock is continuously maintained in fine scale turbulence. For this purpose the flow passages **12*a* and 12*b*** include a plurality of projections extending toward each other, each formed by adjoining flat surfaces, with the apices, or the small radii, where the surfaces join being substantially opposite each other and being moved into opposing closer adjacency when the flow passage is restricted in size.

Thus, I have provided a simplified and compact headbox that is particularly well suited to the handling of foam stock and meets the objectives and advantages above set forth.

I claim as my invention:

1. A headbox for supplying a stock such as a generated liquid foam suspension of fibers or a high consistency paper making stock to a forming surface for forming a fibrous web comprising in combination:

an elongate slice nozzle having an opening through which a stock is ejected for being deposited on a traveling forming surface;

a slice chamber leading to the slice nozzle and having first and second slice flow passages converging toward said slice nozzle, and through which passages the stock flows to said slice nozzle;

a movable block in said slice chamber having convergently related surfaces defining said flow passages on each side of the block between the block and complementary stationary chamber wall portions;

each of said convergently related surfaces and complementary stationary chamber wall portions in each of said flow passages having complementary modulating step configuration cooperative to define a series of restrictions in each flow passage so that the stock flows in continuously changing directions through each of the flow passages for the continuous regeneration of foam or fine scale turbulence of high consistency stock;

means for moving said block rectilinearly for increasing or decreasing the cross sectional flow area of each of said slice flow passages and said restrictions substantially equally for increasing or decreasing the flow volume therethrough;

header chamber means connected to supply stock to said passages; and supply passage means extending from said header chamber means through said movable block and communicating with said flow passages upstream from said modulating step configuration.

2. A headbox for supplying a stock such as a generated liquid foam suspension of fibers or a high consistency paper making stock to a forming surface for forming a fibrous web constructed in accordance with claim 1: and including a header carried on the movable block in communication with said supply passage means and tapering from a wider to a narrow width across the machine with a supply conduit leading to the wider width end and a recirculating conduit leading from the smaller end of the header.

3. A headbox for supplying stock such as a generated liquid foam suspension of fibers or a high consistency paper making stock to a forming surface for forming a fibrous web constructed in accordance with claim 1:

including an inlet line leading into said chamber upstream of said slice flow passages for mixing a fluid with the flow of stock through said flow passages.

4. A headbox for supplying stock such as a generated liquid foam suspension of fibers or a high consistency paper making stock to a forming surface for forming a fibrous web constructed in accordance with claim 1: and including first and second inlet lines respectively leading into the slice chamber at the upstream ends of said first and second flow passages for inducing a fluid to mix with the flows through said flow passages.

* * * * *